US008522998B2

(12) United States Patent
Crookshanks et al.

(10) Patent No.: US 8,522,998 B2
(45) Date of Patent: Sep. 3, 2013

(54) DISHWASHER BASKET ASSEMBLY

(75) Inventors: Kent Allen Stephen Crookshanks, Anderson, SC (US); Ronald Gene Tynes, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 1078 days.

(21) Appl. No.: 12/113,590

(22) Filed: May 1, 2008

(65) Prior Publication Data

US 2008/0272126 A1 Nov. 6, 2008

Related U.S. Application Data

(60) Provisional application No. 60/916,077, filed on May 4, 2007.

(51) Int. Cl.
*B65D 6/08* (2006.01)

(52) U.S. Cl.
USPC ..... 220/488; 220/831; 220/826; 211/41.8

(58) Field of Classification Search
USPC ..... 220/837, 839, 836, 831, 832, 819, 220/822, 824, 826; 211/41.8, 41.9, 70.7, 211/41.2, 41.3; 134/135
See application file for complete search history.

(56) References Cited

U.S. PATENT DOCUMENTS

| | | | | |
|---|---|---|---|---|
| 514,488 | A | 2/1894 | Moore | |
| 745,322 | A * | 12/1903 | Burrough | 220/324 |
| 981,744 | A | 1/1911 | Bowditch | |
| 1,509,549 | A | 9/1924 | Freeland | |
| 2,060,468 | A | 11/1936 | Mitchell | |
| D129,403 | S | 9/1941 | Sedgwick | |
| 2,510,211 | A | 6/1950 | Cleary | |
| 2,676,728 | A | 4/1954 | Smith | |
| 2,815,863 | A | 12/1957 | Larson | |
| 2,979,844 | A | 4/1961 | Lattuca | |
| 3,050,073 | A | 8/1962 | McMillan | |
| 3,182,854 | A | 5/1965 | Geller | |
| 3,236,410 | A | 2/1966 | Swartz | |
| 3,294,308 | A | 12/1966 | Tress et al. | |
| 3,655,088 | A * | 4/1972 | Box | 220/826 |
| 3,655,114 | A | 4/1972 | Turner | |
| 3,665,943 | A | 5/1972 | Lampman et al. | |
| 3,935,958 | A * | 2/1976 | Frangos | 220/488 |
| 3,960,290 | A * | 6/1976 | Yake et al. | 220/835 |
| 3,979,007 | A * | 9/1976 | Thornbloom, Jr. | 220/522 |
| 4,005,800 | A * | 2/1977 | Schurman | 220/831 |

(Continued)

FOREIGN PATENT DOCUMENTS

| | | |
|---|---|---|
| DE | 19540610 | 5/1997 |
| EP | 0143754 | 6/1985 |

(Continued)

*Primary Examiner* — David Fidei
(74) *Attorney, Agent, or Firm* — Alston & Bird LLP

(57) ABSTRACT

Provided is a basket assembly that includes a container portion and a lid rotationally coupled thereto. The lid may include a rib that extends therefrom at a location proximal to an axis of rotation of the lid. The lid may be configured to interfere with an interference portion of the container portion as the lid is rotated between a closed position and an open position relative to the container portion, the interference between the rib and the interference portion being configured to maintain the lid in at least one of the open position and the closed position. Various associated apparatuses are also provided.

23 Claims, 16 Drawing Sheets

(56) References Cited

U.S. PATENT DOCUMENTS

| | | | | | |
|---|---|---|---|---|---|
| 4,157,145 | A | | 6/1979 | Jordan | |
| D254,187 | S | * | 2/1980 | Freese | D32/3 |
| 4,192,432 | A | | 3/1980 | Jordan | |
| 4,193,588 | A | | 3/1980 | Doneaux | |
| 4,318,478 | A | | 3/1982 | De Winter | |
| 4,339,051 | A | | 7/1982 | Crawford | |
| 4,834,125 | A | | 5/1989 | Insalaco | |
| 4,867,332 | A | | 9/1989 | Mains | |
| D304,116 | S | | 10/1989 | Jun | |
| 4,886,166 | A | * | 12/1989 | Bankier et al. | 206/308.3 |
| 4,951,866 | A | | 8/1990 | Rusnak | |
| 4,972,955 | A | | 11/1990 | Rymoen | |
| 5,012,971 | A | | 5/1991 | Cozzi et al. | |
| 5,069,360 | A | | 12/1991 | Dingler et al. | |
| 5,092,463 | A | | 3/1992 | Dees | |
| 5,102,225 | A | | 4/1992 | Hollinger et al. | |
| 5,213,256 | A | | 5/1993 | Cyr | |
| D338,749 | S | | 8/1993 | McConnell | |
| 5,287,984 | A | | 2/1994 | Michael | |
| 5,333,751 | A | | 8/1994 | Santucci, Sr. | |
| 5,360,114 | A | * | 11/1994 | Weidt | 206/506 |
| 5,385,261 | A | | 1/1995 | Lippisch et al. | |
| 5,431,294 | A | | 7/1995 | Stottmann et al. | |
| 5,605,056 | A | | 2/1997 | Brown et al. | |
| 5,645,165 | A | * | 7/1997 | Taniyama | 206/308.1 |
| D391,696 | S | | 3/1998 | Bournay, Jr. et al. | |
| 5,881,906 | A | | 3/1999 | Rogers et al. | |
| 5,899,327 | A | * | 5/1999 | Sykes | 206/307.1 |
| 6,089,375 | A | | 7/2000 | Johnson et al. | |
| 6,092,690 | A | * | 7/2000 | Bitowft et al. | 220/831 |
| 6,161,718 | A | | 12/2000 | Monbo | |
| 6,357,645 | B1 | | 3/2002 | Keefe | |
| 6,371,642 | B1 | | 4/2002 | Nelson et al. | |
| 6,412,735 | B1 | | 7/2002 | Mathieu | |
| 6,454,115 | B1 | * | 9/2002 | Allasia | 220/4.23 |
| D471,679 | S | | 3/2003 | Henzey | |
| D473,985 | S | | 4/2003 | Moreira Da Silva | |
| 6,602,528 | B1 | | 8/2003 | Wells | |
| D481,179 | S | | 10/2003 | Wendt et al. | |
| 6,659,406 | B2 | | 12/2003 | Tsuchida | |
| D487,825 | S | | 3/2004 | Kim et al. | |
| D488,891 | S | * | 4/2004 | Smith et al. | D32/3 |
| D489,960 | S | | 5/2004 | Grendahl | |
| D501,125 | S | | 1/2005 | Winig et al. | |
| D502,295 | S | * | 2/2005 | Feddema | D32/3 |
| 6,857,526 | B2 | | 2/2005 | Vollmer | |
| D502,638 | S | | 3/2005 | Winig et al. | |
| 6,868,977 | B2 | | 3/2005 | Rosenbauer et al. | |
| 6,918,508 | B2 | * | 7/2005 | Hwang | 220/826 |
| 6,945,421 | B2 | | 9/2005 | Phifer | |
| D517,253 | S | | 3/2006 | Raches et al. | |
| 7,137,397 | B2 | | 11/2006 | Rosenbauer et al. | |
| 7,267,238 | B2 | | 9/2007 | Yang et al. | |
| 7,861,883 | B2 | | 1/2011 | Purushothaman | |
| 2002/0139809 | A1 | | 10/2002 | Barry et al. | |
| 2004/0031508 | A1 | | 2/2004 | Rosenbauer et al. | |
| 2004/0079713 | A1 | | 4/2004 | Wendt et al. | |
| 2004/0094555 | A1 | | 5/2004 | Raches et al. | |
| 2005/0109378 | A1 | | 5/2005 | Landsiedel et al. | |
| 2005/0241686 | A1 | | 11/2005 | Woo | |
| 2005/0242046 | A1 | | 11/2005 | Lee | |
| 2005/0268945 | A1 | | 12/2005 | Hedstrom et al. | |
| 2006/0065666 | A1 | | 3/2006 | Dunn et al. | |
| 2006/0191948 | A1 | * | 8/2006 | Wisniewski et al. | 220/831 |
| 2006/0237051 | A1 | | 10/2006 | Bengston et al. | |
| 2006/0243681 | A1 | | 11/2006 | Batsuji et al. | |
| 2006/0289041 | A1 | | 12/2006 | Woo | |
| 2007/0039905 | A1 | * | 2/2007 | Purushothaman | 211/41.8 |
| 2007/0039971 | A1 | | 2/2007 | Purushothaman | |

FOREIGN PATENT DOCUMENTS

| | | |
|---|---|---|
| EP | 0385877 | 9/1990 |
| EP | 0697187 | 2/1996 |
| WO | WO 04/000090 | 12/2003 |

* cited by examiner

DISHWASHER BASKET ASSEMBLY

CROSS REFERENCE TO A RELATED APPLICATION

The present application claims the benefit of U.S. Provisional Patent Application No. 60/916,077 filed on May 4, 2007, which application is incorporated herein by reference in its entirety.

FIELD OF THE INVENTION

Embodiments of the present invention relate to dishwashers, and more particularly, to baskets and basket assemblies for holding items such as silverware and the like in a dishwasher.

BACKGROUND

Conventional dishwashers have a washing chamber in which one or more racks are movably mounted. The racks typically are defined by a lattice structure adapted to hold items such as dishes, plates, glasses, cups, pots and pans for washing within the washing chamber. At least one of the racks normally has a silverware basket mounted to or formed therein for holding knives, forks and spoons.

Some silverware baskets have several compartments for holding items of different size or shape. However, improved silverware baskets capable of handling a greater variety of items are still needed. Further, silverware baskets equipped to better facilitate loading, unloading, and the holding of items during washing are also desired.

SUMMARY

In one aspect, a basket assembly is provided that includes a container portion and a lid rotationally coupled thereto. The lid may include a rib that extends therefrom at a location proximal to an axis of rotation of the lid. The lid may be configured to interfere with an interference portion of the container portion as the lid is rotated between a closed position and an open position relative to the container portion, the interference between the rib and the interference portion being configured to maintain the lid in at least one of the open position and the closed position. For example, the interference portion may be configured to interfere with the rib so as to maintain said lid in substantially the open position subsequent to the lid being rotationally urged past the interference portion toward the open position. In some cases, the interference portion may be configured to interfere with the rib only when the lid is in an intermediate position between the closed position and the open position.

In some embodiments, at least one of the interference portion and the rib may be resiliently deformable so as to facilitate the lid being rotationally urged past the interference portion. For example, the interference portion can be cantilevered with respect to the container portion. The cantilevered interference portion may define a concavity configured to receive the rib subsequent to the lid being rotationally urged past the interference portion toward the open position, such that the rib is disposed within the concavity when the lid is substantially in the open position.

In another aspect, a basket assembly is provided that includes a container portion and a handle coupled to the container portion. The handle can include a grip portion, and the handle may be coupled to the container portion such that the grip portion extends in a handle direction with respect to the container portion. A first lid can be rotationally coupled to the container portion adjacent to the grip portion. The first lid may have a first axis of rotation substantially perpendicular to the handle direction of the grip portion. The first lid can be configured to be rotatable in a first rotational direction about the first axis of rotation to an open position allowing access to the grip portion.

The basket assembly may further include a second lid rotationally coupled to the container portion adjacent to the first lid and the grip portion. The second lid may have a second axis of rotation substantially perpendicular to the handle direction of the grip portion and may be configured to rotate in a second rotational direction that is opposite to the first rotational direction. The first and second axes of rotation may be spaced apart a distance greater than a length of the grip portion. The second lid may be rotatable in the second rotational direction about the second axis of rotation to an open position allowing access to the grip portion. Further, the first and second lids can include respective distal ends opposing the corresponding one of the first and second axes of rotation, and can be rotatable about the respective first and second axes of rotation to respective substantially closed positions, whereby the distal ends of the first and second lids are adjacently disposed. In some embodiments, when said first and second lids are disposed in the respective open positions, the respective distal ends are spaced apart so as to allow access to the grip portion.

In yet another aspect, a basket assembly is provided that includes a container portion and a lid operably engaged with the container portion. The lid extends along a lid plane across an opening defined by the container portion when the lid is in a closed position. The lid may be rotationally coupled with the container portion so as to be rotatable about an axis of rotation. For example, the lid may be rotationally coupled to the container portion via a coupling structure that includes protrusions extending from opposite sides of the lid, the protrusions being configured to be received by corresponding mating structures defined by the container portion and disposed along the axis of rotation. Alternatively, the coupling structure may include a pair of opposing cavities configured to receive mating structures defined by the container portion. The coupling structure can be configured to maintain the lid in an open position relative to the container portion.

A fin can be operably engaged with and extend from the lid in a direction substantially perpendicular to the lid plane. The fin generally defines a plane that extends perpendicularly to the axis of rotation, and in some cases the fin may be substantially planar. In some cases, the fin can be disposed about a perimeter of the lid.

In still another aspect, a lid for a basket is provided that includes a lid body and a coupling structure associated with said lid body and configured to rotationally couple the lid to the basket. The coupling structure can define an axis of rotation about which the lid rotates when coupled to the basket. A fin can extend from the lid body in a direction substantially perpendicular to a plane generally defined by the lid body, the fin generally defining a plane extending perpendicularly to the axis of rotation.

In yet another aspect, a basket assembly is provided that includes a container portion and a lid rotationally coupled to the container portion. The lid can be adapted to receive an elongated item therethrough into the container portion when the lid is disposed in each of a first rotational position and a second rotational position, for example, respective substantially perpendicular open and closed positions. The lid can be rotatable about an axis of rotation between an open position substantially aligned with a depth of the container portion and a closed position substantially aligned with a lateral direction of said container portion. The lid may define a lid plane and further include spaced apart first and second lid members disposed parallel to the lid plane and a third lid member disposed perpendicular to the lid plane, the third lid member being operably engaged between the first and second lid members. Each of the first, second, and third lid members may define an aperture adapted to receive the elongated item therethrough.

In still another aspect, a lid for a basket assembly is provided, the lid including a lid body structure adapted to be rotationally coupled to a container portion of a basket and to rotatable between at least a first and a second orientation, wherein the lid body structure is configured to allow an elongated item to pass therethrough in each of the first and second orientations. For example, the lid body structure can include a three-dimensional lattice that allows items to pass therethrough with the lid body structure in a first orientation and a second orientation that is not aligned with the first orientation. For example, the second orientation may be perpendicular to the first orientation. The three-dimensional lattice may include opposing first and second lattice surfaces and a third lattice surface, each of the first and second lattice surfaces being generally perpendicular to the third lattice surface. The first, second, and third lattice surfaces can each be configured to define spaces respectively dimensioned to accommodate the elongated item.

In yet another aspect, a basket is provided that includes a container portion defining an opening and having spaced apart and opposing first and second wall portions. Each of the opposing first and second wall portions may have an edge disposed adjacent to the opening that is concavely configured with respect to a depth of the container portion. The first and second wall portions can be aligned to receive an elongated item within the respective concavities defined thereby, across the container portion.

In some embodiments, the container portion may further include spaced apart and opposing third and fourth wall portions respectively extending between and operably engaging the first and second wall portions, each of the third and fourth wall portions having an edge disposed adjacent to the opening. A lid may be rotationally coupled to the container portion so as to be rotatable about an axis of rotation parallel to the third and fourth walls between an open position exposing the opening and a closed position covering the opening. The lid may be rotatable toward the closed position to retain the elongated item within the concavities defined by the first and second wall portions.

In still another aspect, a basket assembly is provided that includes a container portion defining a keyway having contiguous wider and narrower regions, the narrower region being at least partially bounded by opposing oblique sides. The wider and narrower regions of the keyway may be substantially aligned along a depth direction of the container portion. The basket assembly may further include a lid having a protrusion extending therefrom along an extension direction. The protrusion has a cross-section defined transversely to the extension direction with the cross-section having a longer dimension and a shorter dimension, wherein the wider region of the keyway is configured to accommodate the longer dimension of said protrusion and the narrower region of the keyway is configured to accommodate the shorter dimension of said protrusion. For example, the cross-section of the protrusion can be substantially elliptical.

BRIEF DESCRIPTION OF THE SEVERAL VIEWS OF THE DRAWING(S)

Reference will be made to the accompanying drawings, which are not necessarily drawn to scale, and wherein.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
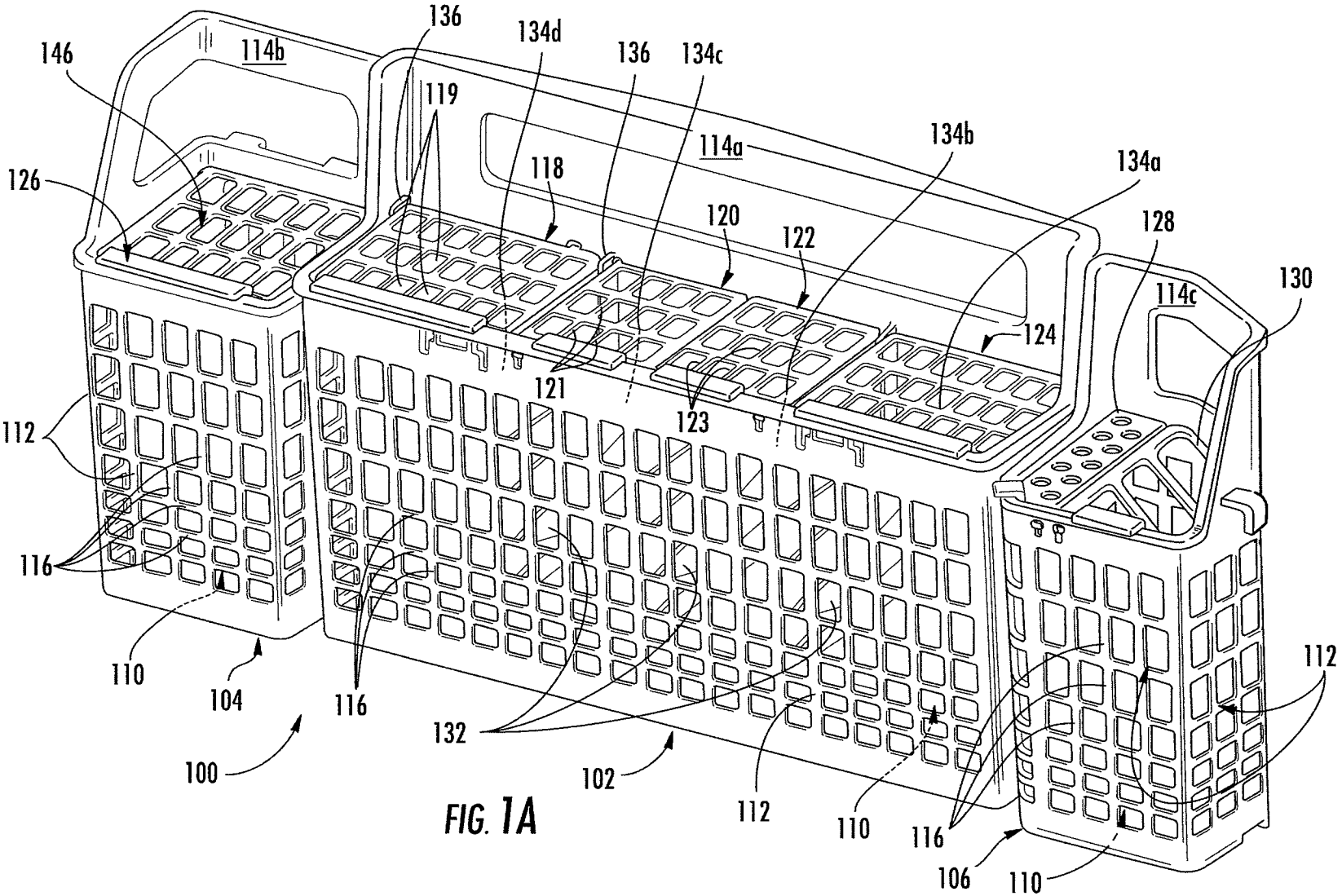
FIG. 1A is a perspective view of a basket assembly configured in accordance with an exemplary embodiment.
Figure 1B:
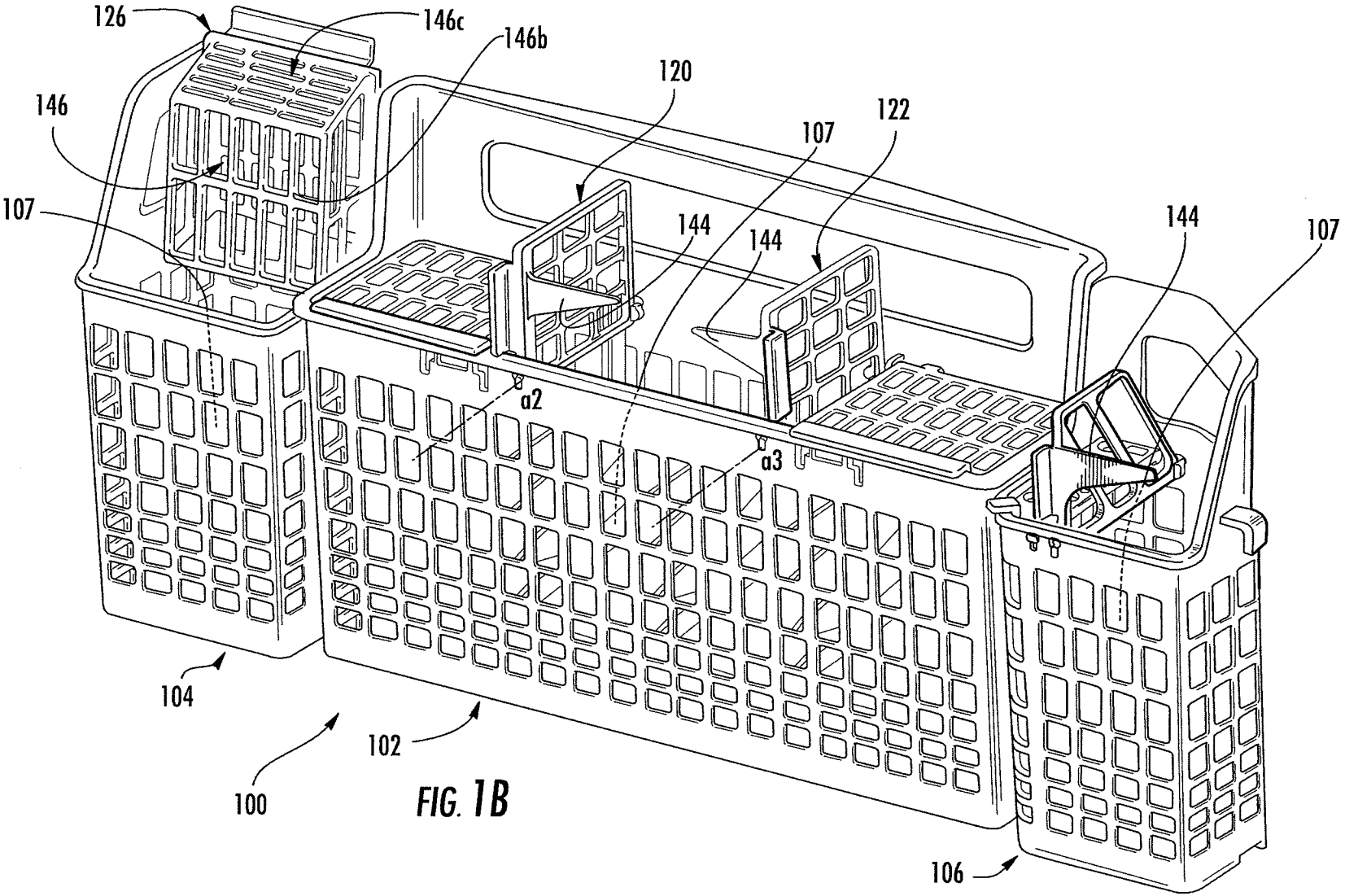
FIG. 1B is a perspective view of the basket assembly of FIG. 1A, showing various of the lids in open positions and/or upright positions.
Figure 2A:
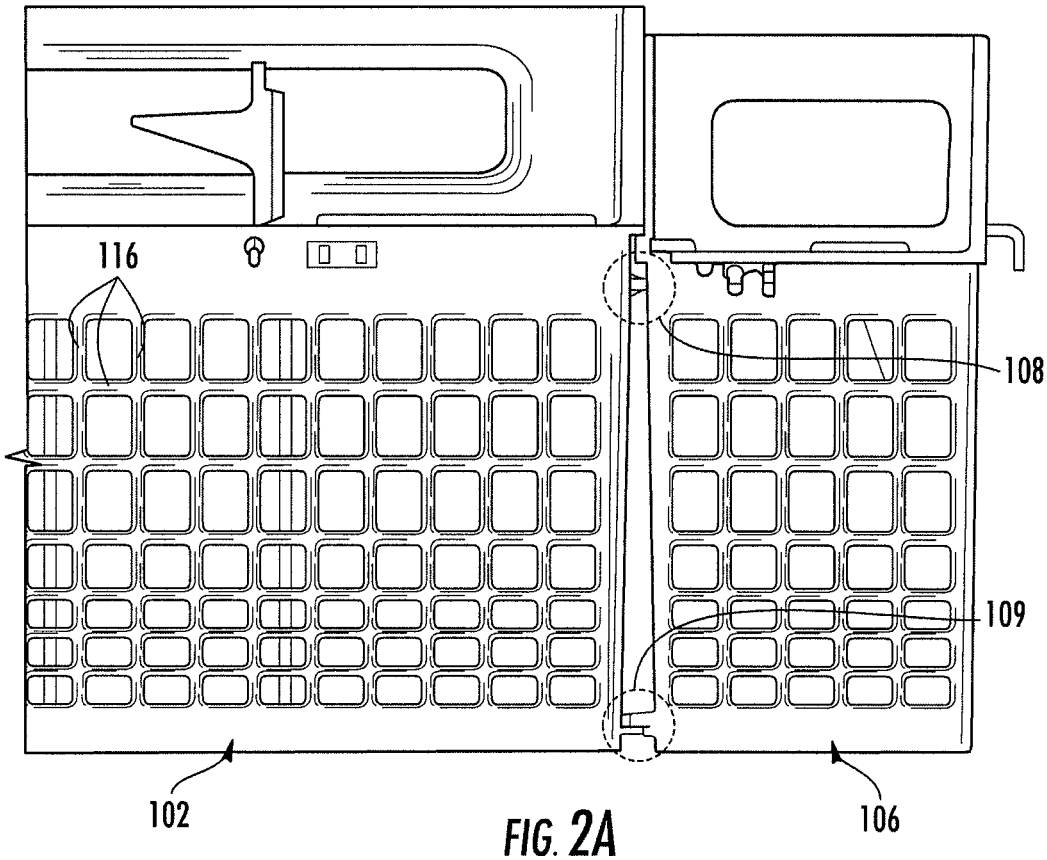
FIG. 2A is a side view of a portion of the basket assembly of FIG. 1A showing the coupling mechanism between the main basket and one a supplemental basket.
Figure 2B:
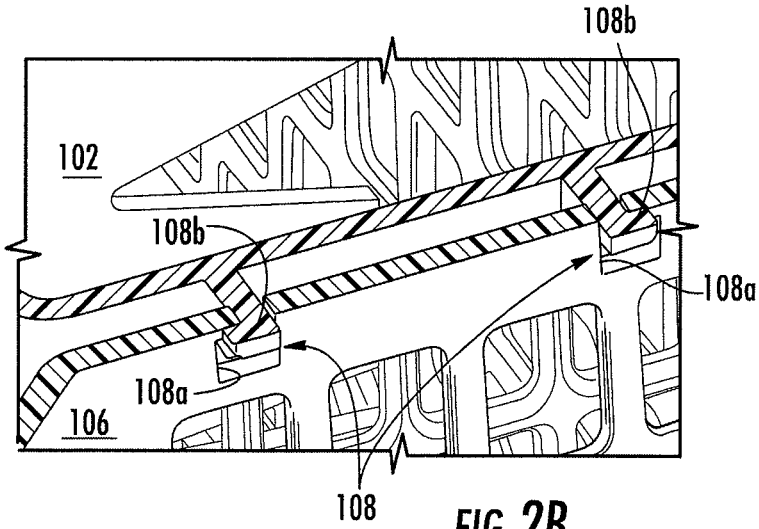
FIG. 2B is a perspective view in partial cross section of the coupling mechanism of FIG. 2A.
Figure 2C:
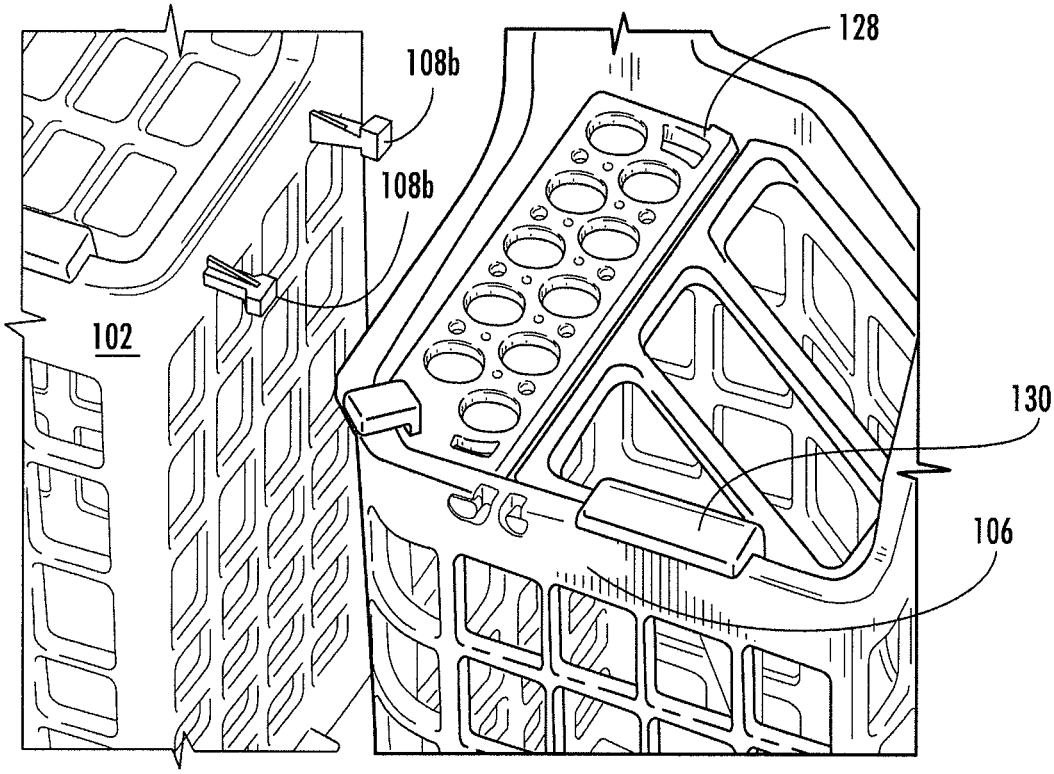
FIGS. 2C and 2D are perspective views of the main basket and the supplemental basket of FIG. 2A, the main basket being decoupled from the supplemental basket to reveal aspects of the coupling mechanism.
Figure 2D:
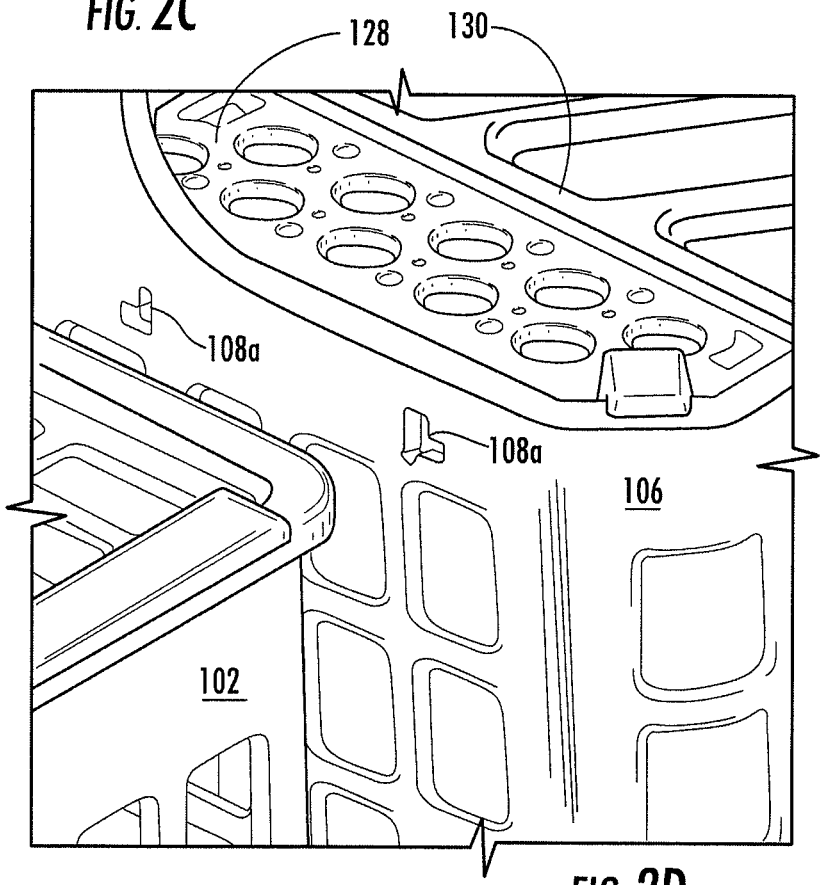
Figure 2E:
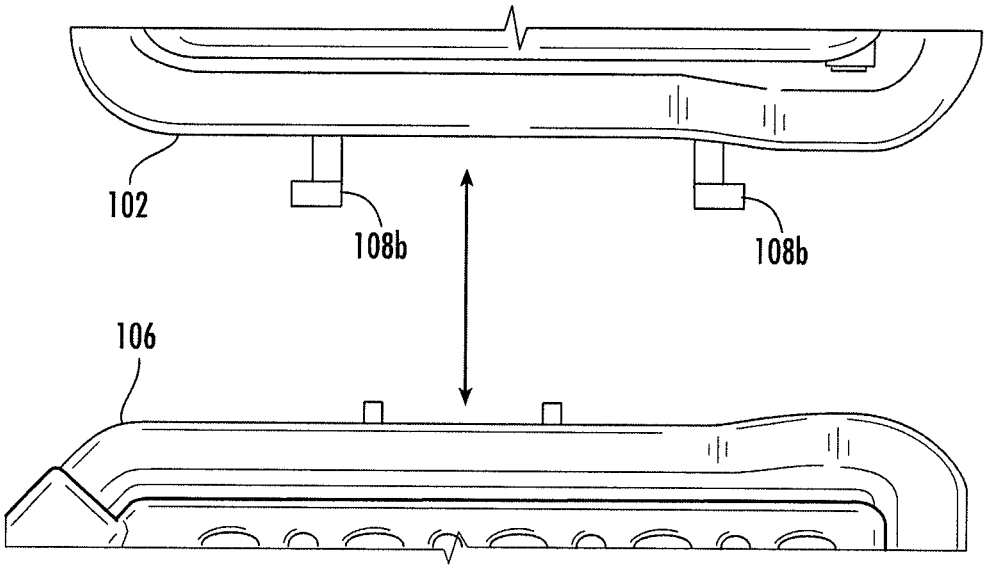
FIG. 2E is a plan view of the decoupled main basket and supplemental basket of FIGS. 2C and 2D.
Figure 2F:
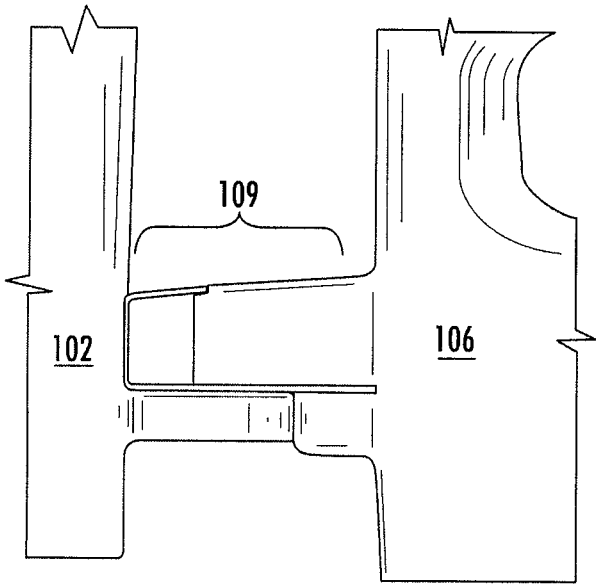
FIG. 2F is a magnified side view of the main basket and the supplemental basket of FIG. 2A, showing steps defined by each of the main and supplemental baskets.
Figure 3A:
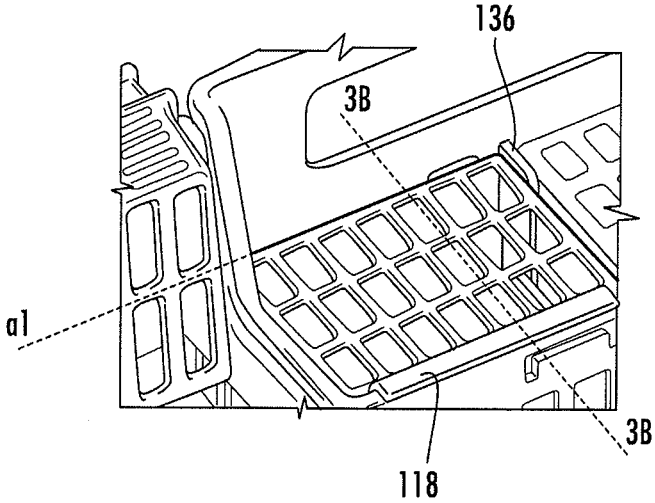
FIG. 3A is a perspective view of a portion of the basket assembly of FIG. 1A, showing a lid in a closed position.
Figure 3B:
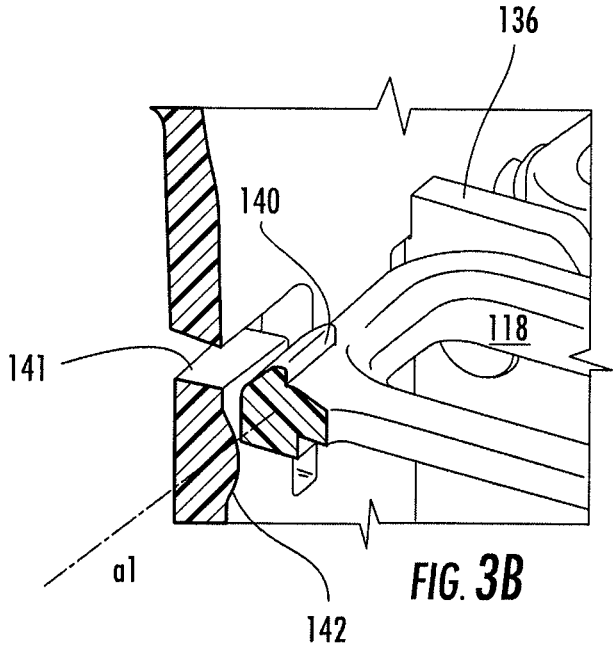
FIG. 3B is a magnified perspective view, in cross section, of the lid of FIG. 3A.
Figure 3C:
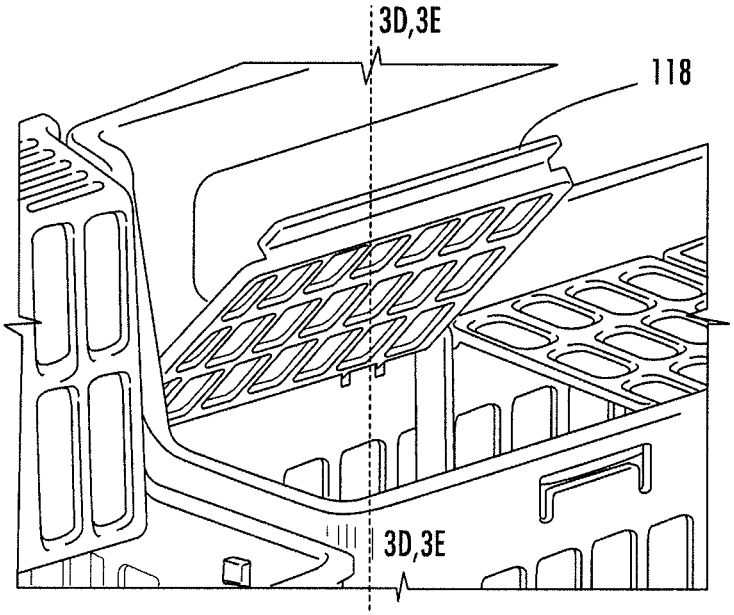
FIG. 3C is a perspective view of a portion of the basket assembly of FIG. 1A, showing the lid in a partially open position.
Figure 3D:
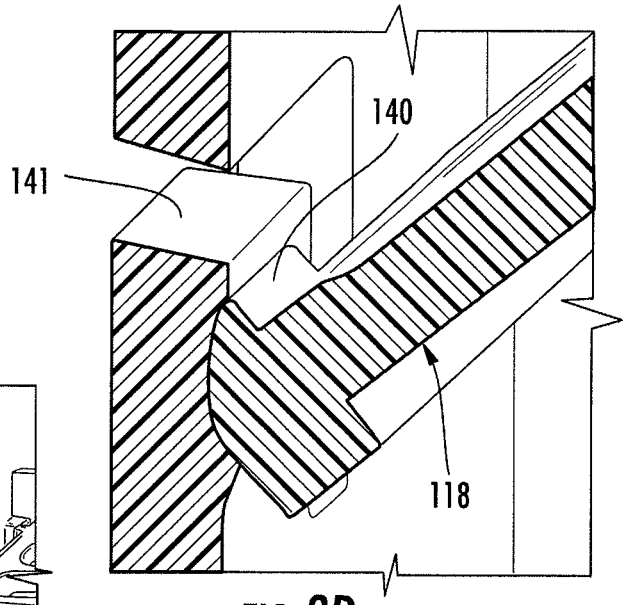
FIG. 3D is a magnified perspective view, in cross section, of the lid of FIG. 3C, showing the interaction of the rib and a portion of the basket.
Figure 3E:
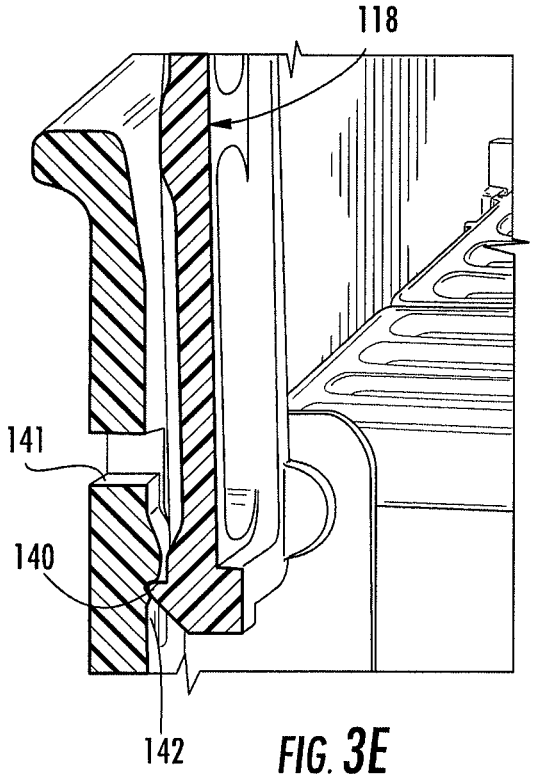
FIG. 3E is a magnified perspective view, in cross section, showing the lid in an open position.

Referring to FIGS. 1A and 1B, therein is shown a basket assembly 100 configured in accordance with an exemplary embodiment. The basket assembly 100 may be used, for example, in a dishwasher, to hold items such as silverware, cooking utensils, and other kitchen implements and/or items of relatively small or moderate size. The basket assembly 100 includes a main basket 102, a first supplemental basket 104, and a second supplemental basket 106. The illustrated basket assembly includes two supplemental baskets, but more or less than two such supplemental baskets may also be used. In addition, the use of the terms "main" and "supplemental" herein should not be construed to imply that the baskets 102, 104, 106 must be of different sizes, or that one is necessarily supported by the other. Each of the baskets 102, 104, 106 can be permanently or removably secured to each other and/or to a rack within the dishwasher.

Referring to FIGS. 1A, 1B, and 2A-2F, the first and second supplemental baskets 104, 106 may be independent from, but capable of being coupled to, the main basket 102. The main basket 102 and/or supplemental baskets 104, 106 may include a coupling mechanism 108 that allows either or both of the supplemental baskets 104, 106 to be selectively decoupled from and re-coupled to the main basket 102. For example, each supplemental basket 104, 106 may define an opening in the form of a keyway 108*a* that accepts a respective protrusion 108*b* formed on the main basket 102, thereby securing each respective supplemental basket 104, 106 to the main basket 102. Each supplemental basket 104, 106 may then be manually separated from the main basket 102 by simply moving the respective supplemental basket laterally (e.g., upwardly as oriented in the figure) and then axially relative to the main basket. Main basket 102 and/or supplemental baskets 104, 106 may include stops 109 that contact an opposing basket or one another when main basket 102 and one of the supplemental basket 104, 106 are coupled together. That is, one or more stops 109 may be included, each stop 109 extending partially or completely between main basket 102 and either of supplemental baskets 104, 106. Other types of coupling mechanisms, such as hooks, interference fit parts, and/or spring-loaded tongs, may also be employed.

All of the main and supplemental baskets 102, 104, 106 include container portions 107 that have bottom surfaces 110 and side surfaces 112 that together generally define a volume. All of the main and supplemental baskets also include respective handles 114*a-c*, which may be integrally formed together with the bottom and side surfaces 110, 112. For example, each of the main and supplemental baskets 102, 104, 106, including the respective bottom surfaces 110, side surfaces 112, and handles 114*a-c*, may be respectively formed by injection or rotational molding. All of the surfaces 110, 112 may be formed of a lattice of interlinked cross-pieces 116 that are spaced apart from one another and thereby generally serving to contain objects larger than the spacing of adjacent cross-pieces, such as silverware, while allowing smaller objects, such as small food particles, and liquid to pass through the surfaces 110, 112. The main and supplemental baskets can further include one or more lids 118, 120, 122, 124, 126, 128, 130 that, together with the bottom and side surfaces, serve to define the volume of the respective basket. The lids may be formed independently of the baskets, thereby allowing each of the lids to move relative to the respective basket to which it is coupled. The configuration of each of the lids 118, 120, 122, 124, 126, 128, 130 and the manner in which each of the lids 118, 120, 122, 124, 126, 128, 130 couples to the respective basket 102, 104, 106 is described in more detail below.

The main basket 102 may have a first lid 118, a second lid 120, a third lid 122, and a fourth lid 124. The main basket 102 may also include partitions 132 that serve to separate the main basket 102 into four compartments 134*a-d*, in which case each compartment 134*a-d* may be enclosed by a respective one of the lids 118, 120, 122, 124. In the illustrated embodiment, the first lid 118 and the fourth lid 124 are substantially the same as one another, although this need not be the case. The first lid 118 defines an array of slats 119 sized, for example, to accept common silverware. The slats 119 may or may not be uniform in size. The first lid 118 is rotationally coupled to the main basket 102 proximal to the handle 114*a*, for example, by a hinge structure 136.

Referring to FIGS. 3A-3E, the first lid 118 includes a rib 140 that extends from the lid at a location proximal to the axis a1 about which the lid rotates. The rib 140 is configured to engage an interference portion 141 of the main basket 102 as the first lid 118 is rotated into an open position. The rib 140 may contact the interference portion 141 as the first lid 118 is rotated from a closed position to an open position, such that the first lid and/or the interference portion 141 deform as the first lid is rotated. The interference portion 141 may define a concavity 142, such that the rib 140 is received within the concavity when the first lid 118 is substantially completely open (e.g., at the end of its rotational range of approximately 90 degrees). The reception of the rib 140 by the concavity 142 may result in the first lid 118 being stably maintained in the open position when so rotated.

In one embodiment, the interference portion 141 may be cantilevered with respect to the main basket 102, such that the interference portion is more easily deformed as the rib 140 contacts and moves past the interference portion 141. In some embodiments, the interference portion 141 may define a convex region rather than a concavity, or may define both a concavity and a convex region. In some embodiments, one or both of the interference portion 141 and the rib 140 may be resiliently deformable to facilitate the interference process during rotation of the first lid 118.

Referring again to FIGS. 1A, 1B, and 4, the second and third lids 120, 122 each include an array of slats 121, 123, which may or may not be sized uniformly, and may or may not be sized similarly for both of the lids 120, 122. Each of the second and third lids 120, 122 is rotationally connected to the main basket 102 and has a respective axis of rotation a2, a3 that extends substantially perpendicularly away from the plane generally defined by the handle 114*a*, such that the lids 120, 122 open by rotating away from one another. As such, when either or both the second lid 120 and the third lid 122 are in an open position, the handle 114*a* may be grasped without obstruction by the lids 120, 122. In one embodiment, there may be no partition between the locations at which the second and third lids 120, 122 are connected to the main basket 102, such that both the lids 120, 122 serve to partially enclose a larger volume. In another embodiment, a removable partition may be included in the space between the second and third lids 120, 122, while in other embodiments, all of the partitions 132 may be removable.

Figure 4:
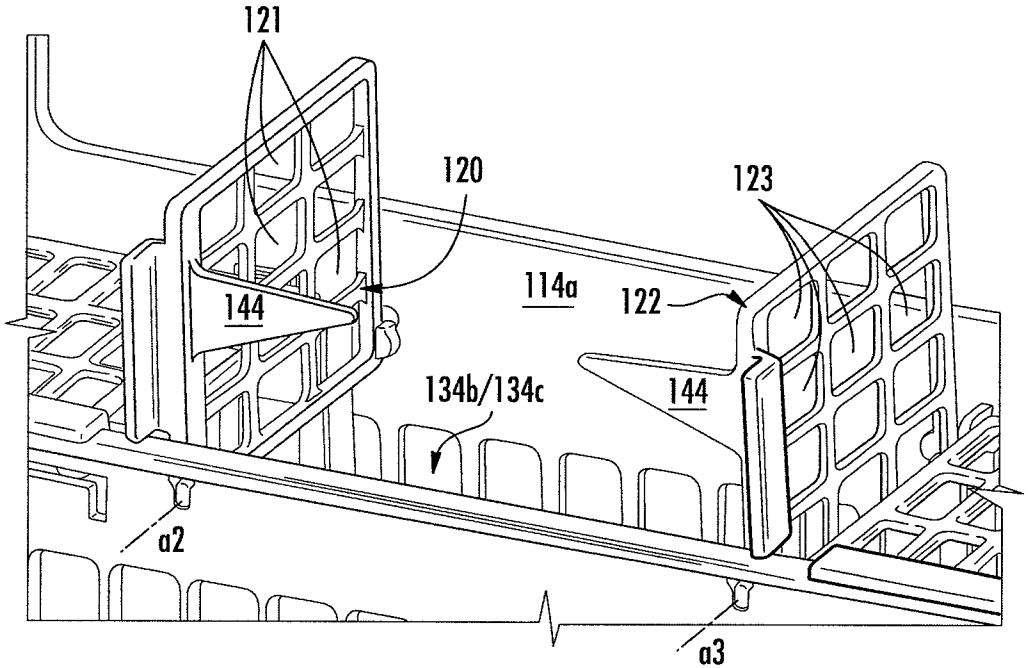
FIG. 4 is a magnified perspective view of the main basket of FIG. 1B, showing lids in the open position.

Each of the second and third lids 120, 122 may also include a respective fin 144, each of which is substantially planar and extends perpendicularly to the plane generally defined by the lid 120, 122 and tangentially to the respective axis of rotation a2, a3 of the lid 120, 122. When the lids 120, 122 are in an open position, as shown in FIG. 4, relatively long items may be inserted into the compartments 134*b*, 134*c*, while the fins 144 are configured to serve as a physical stop for the inserted items, which might otherwise have a tendency to rotate in a direction away from the handle 114*a* and slide out of the compartments 134*b*, 134*c*.

Figure 5A:
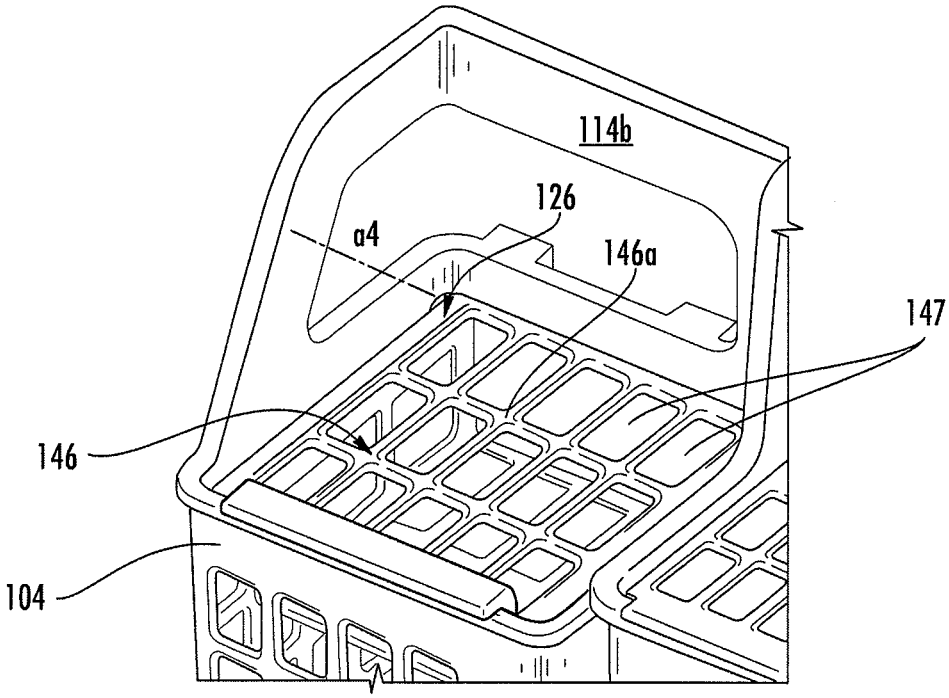
FIGS. 5A and 5B are magnified perspective views of the supplemental basket of FIG. 1A, showing the lid in the flat and upright positions, respectively.
Figure 5B:
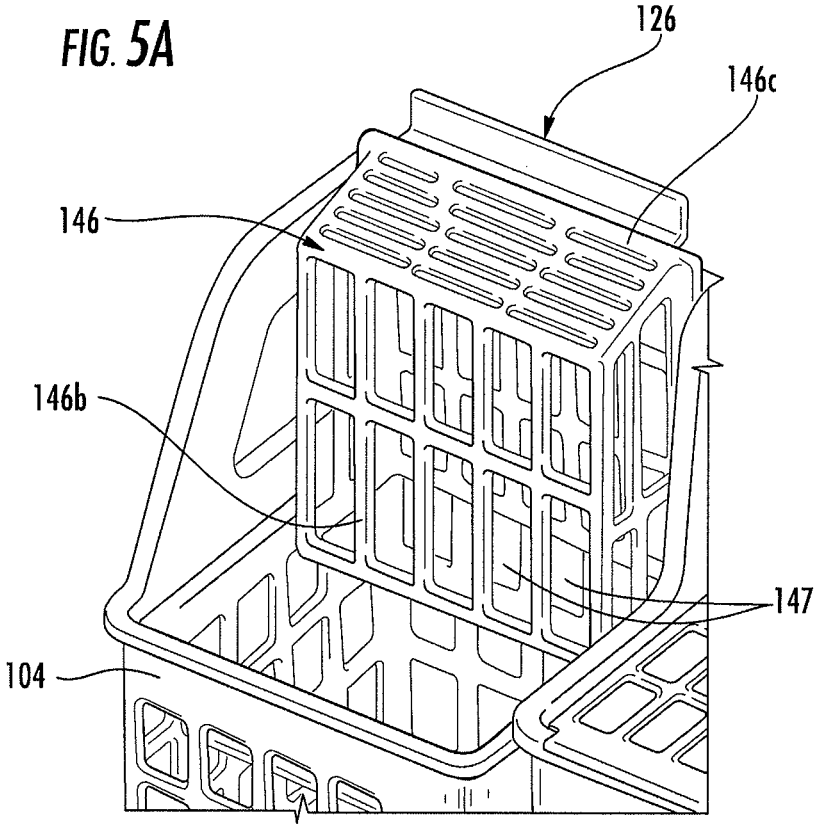
Figure 6A:
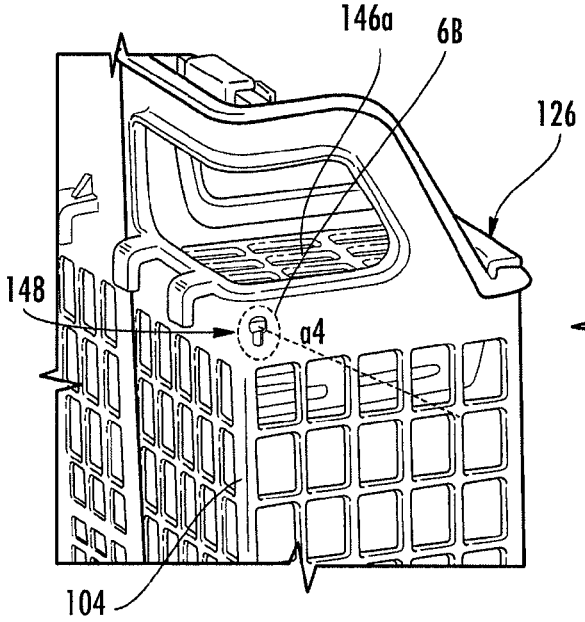
FIG. 6A is a perspective view of the basket assembly of FIG. 1A, showing the lid in the flat position.
Figure 6B:
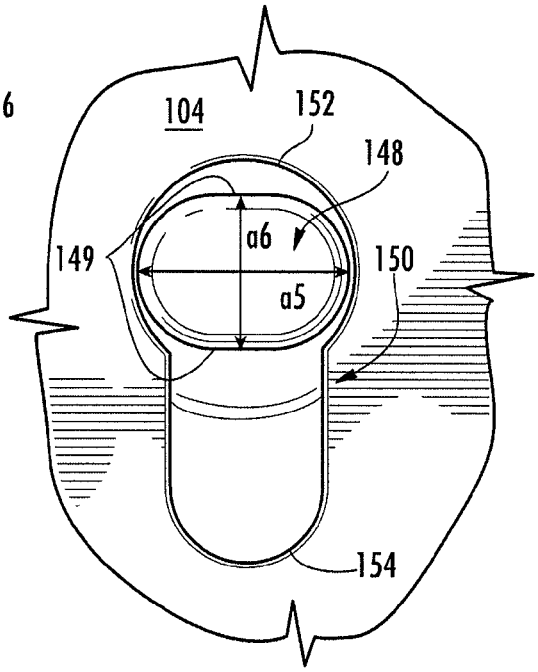
FIG. 6B is a magnified side view of the configuration of the button defined by a lid and the corresponding keyway defined by a supplemental basket when the lid is in the flat position.
Figure 6C:
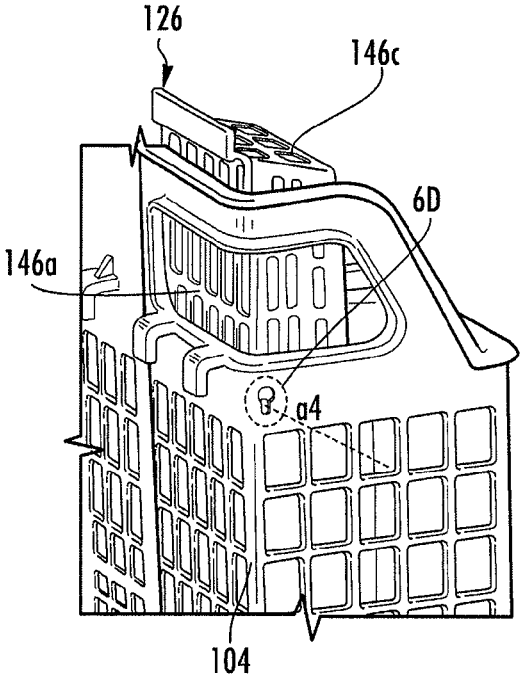
FIG. 6C is a perspective view of the basket assembly of FIG. 1B, showing the lid in the upright position.
Figure 6D:
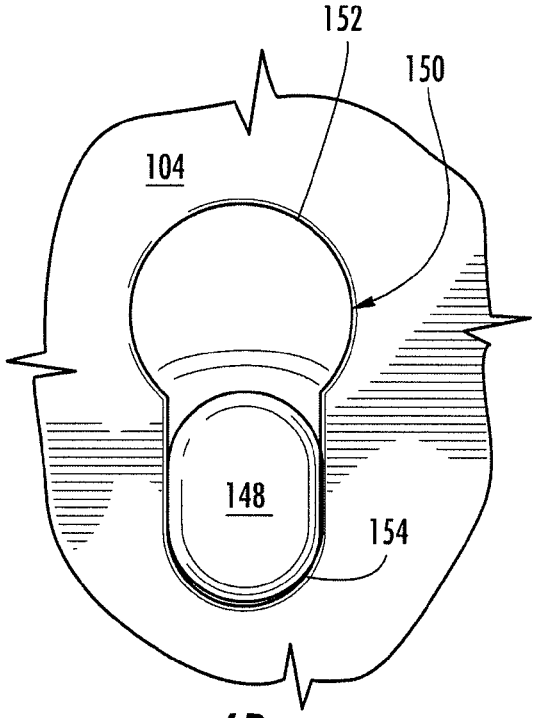
FIG. 6D is a magnified side view of the configuration of the button defined by a lid and the corresponding keyway defined by a supplemental basket when the lid is in the upright position.
Figure 7:
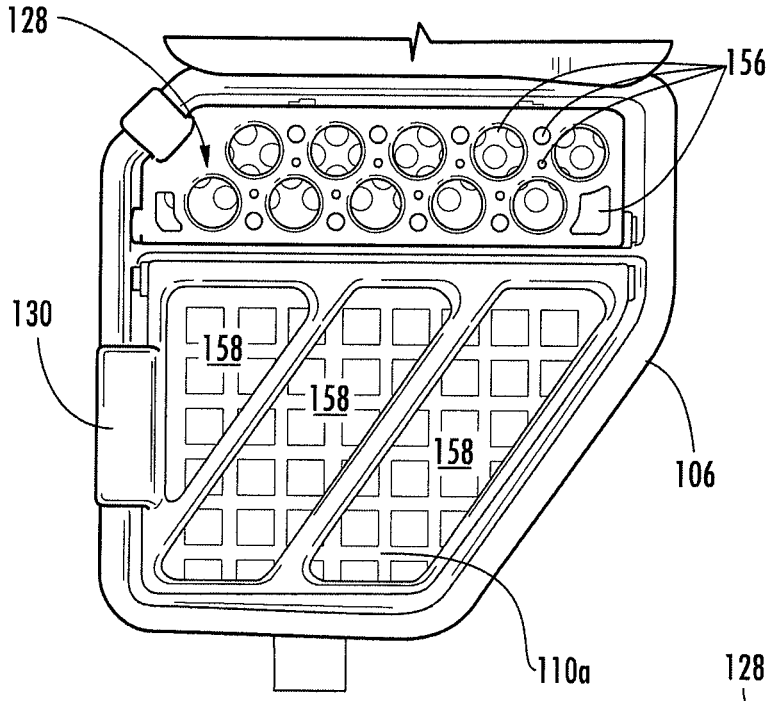
FIG. 7 is a plan view of a supplemental basket and applicable lids.
Figure 8:
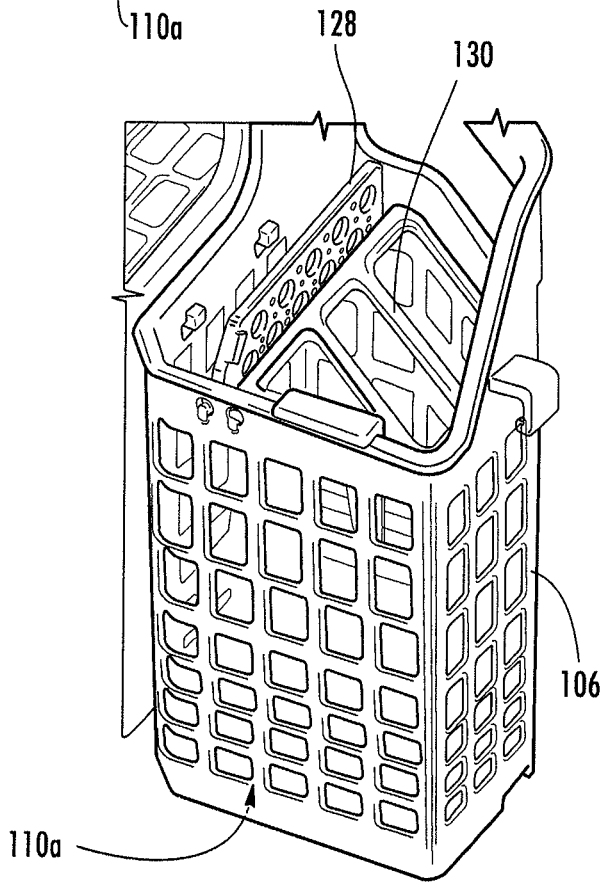
FIG. 8 is a perspective view of a supplemental basket and applicable lids, one lid being in an open position.
Figure 9:
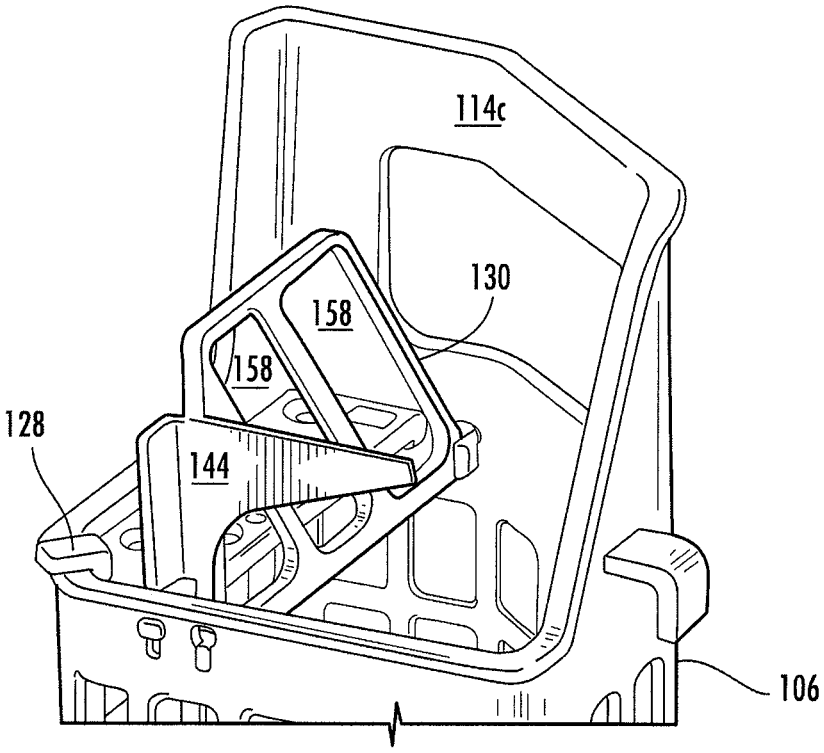
FIG. 9 is a perspective view of a supplemental basket and applicable lids, one lid being in an open position.
Figure 10:
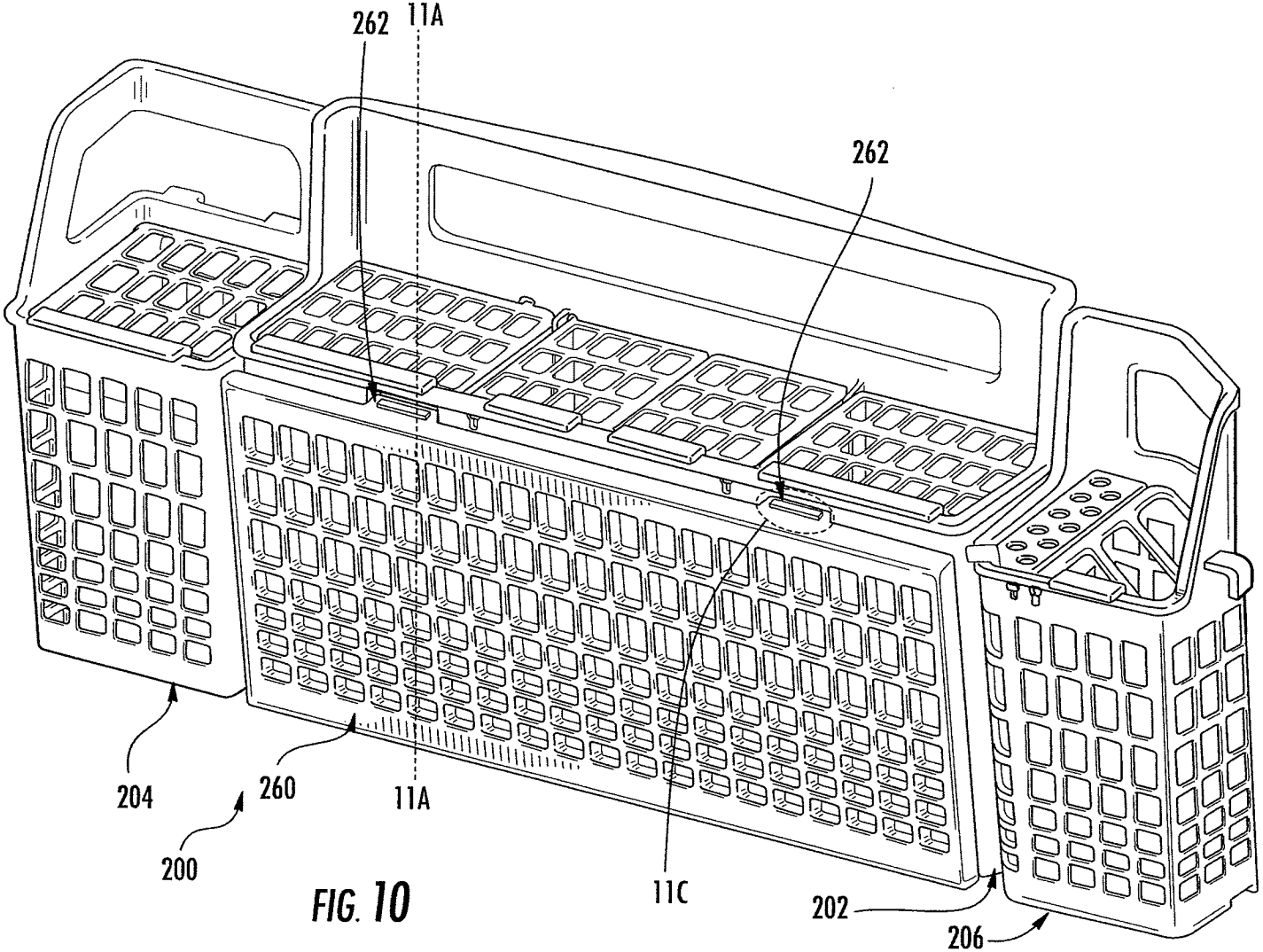
FIG. 10 is a perspective view of a basket assembly configured in accordance with another exemplary embodiment, the basket assembly including another supplemental basket.
Figure 11A:
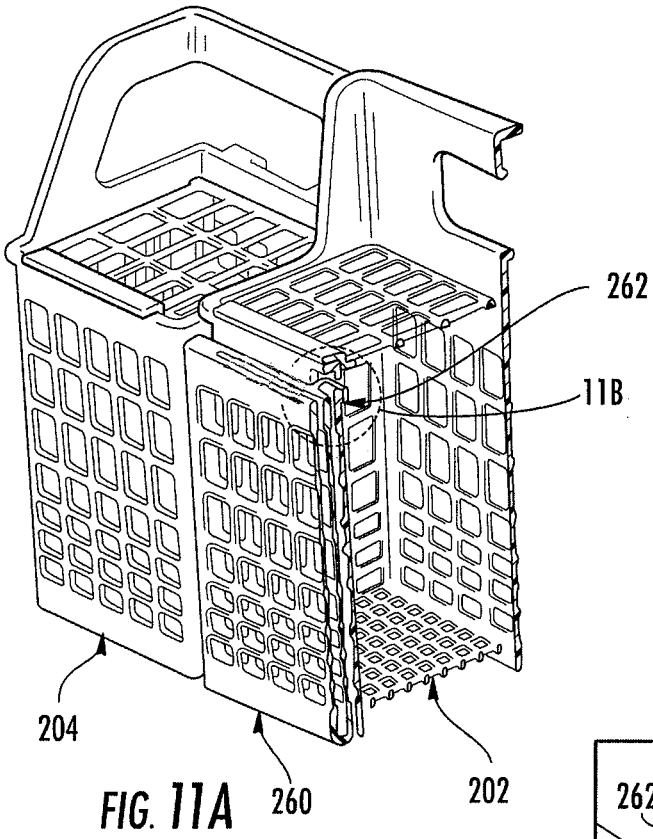
FIGS. 11A-11C are magnified perspective views of the basket assembly of FIG. 10, showing the coupling mechanism between the main basket and the supplemental basket.
Figure 11B:
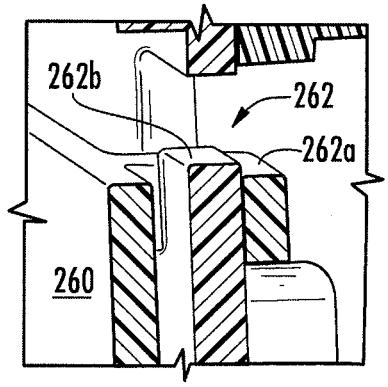
Figure 11C:
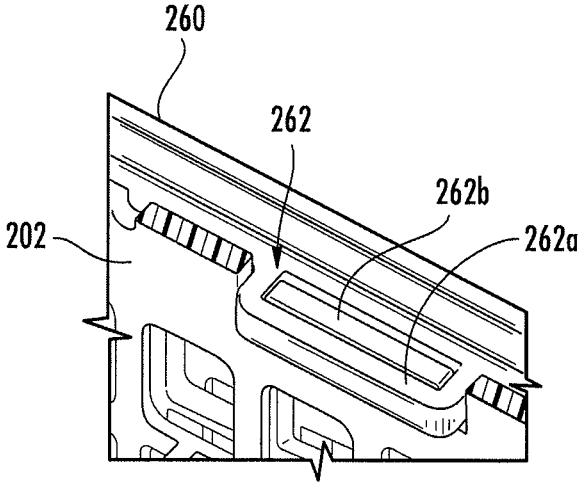

Referring to FIGS. 1A, 1B, 5A, 5B, and 6A-6D, the first supplemental basket 104 may include a fifth lid 126. The fifth lid 126 may include a three-dimensional lattice 146 having first lattice surface 146*a* that is opposed to a second lattice surface 146*b*. The lattice 146 may further include a third lattice surface 146*c*. First and second lattice surfaces 146*a*, 146*b* may be geometrically similar to one another, such that slats 147 defined by each lattice align with those defined by the opposing lattice. When fifth lid 126 is oriented as shown in FIGS. 1A, 5A and 6A (hereinafter referred to as the "flat" position), elongated items may be inserted through and supported by cooperation of first and second lattice surfaces 146*a*, 146*b*. Fifth lid 126 may also be oriented as shown in FIGS. 1B, 5B, and 6C, this position of the lid being termed the "upright" position. When fifth lid 126 is in the upright position, relatively longer items may be inserted through and supported by the third lattice surface 146*c*. In one embodiment, the fifth lid 126 may be especially configured to accept and support knives of various sizes.

The fifth lid 126 may include opposing protrusions or buttons 148 that extend into opposing openings or keyways 150 defined by the first supplemental basket 104, this coupling allowing the fifth lid 126 to rotate relative to the first supplemental basket 104, around an axis a4 connecting the buttons 148. The buttons 148 may have a non-circular cross section, for example, by including flats 149 such that the overall shape of each button is approximately elliptical, with a long axis a5 having a longer dimension and a short axis a6 having a shorter dimension. The keyways 150 include a wider, circular section 152 and a narrower section 154. When the fifth lid 126 is in the flat position, the buttons 148 rest in the wider sections 152 of the keyway 150. The buttons 148 are then free to rotate within the keyways 150. When the fifth lid 126 is in the upright position, the buttons 148 tend to rest in the narrower sections 154 of the keyway 150. The buttons 148 are configured such that short axis a6 is similar to the width of the narrower section 154, and the keyways 150 then tend to physically restrict rotation of the buttons 148. This design may thus stably maintain the fifth lid 126 when placed in the upright position. The fifth lid 126 can be moved from the upright to the flat position by manually lifting the buttons 148 out of the narrower sections 154 of the keyways 150 and then rotating the buttons 148 in the wider section 152.

Referring again to FIGS. 1A, 1B, and 7-9, the second supplemental basket 106 may include a sixth lid 128 and a seventh lid 130. The sixth lid 128 is generally planar and defines an array of openings 156 sized, for example, to fit therein relatively narrow objects, such as chopsticks, straws, skewers, and the like. The bottom surface 110*a* of the second supplemental basket 106 may be formed of a lattice having a relatively small characteristic spacing of the constituent cross-pieces, for supporting relatively narrow objects extending through and supported by the openings 156. The seventh lid 130 defines slats 158 that are relatively wide so as to allow passage therethrough of relatively wide objects, such as the wide end of a spoon. Both the sixth and seventh lids 128, 130 may be rotationally coupled to the second supplemental basket 106, for example, using coupling mechanisms as discussed earlier with respect to other lids. Also, one or both of the sixth and seventh lids 128, 130 may include a fin 144 similar to the fins 144 discussed earlier with respect to the second and third lids 120, 122.

Referring to FIGS. 10 and 11A-11C, therein are several views of a basket assembly 200 configured in accordance with another exemplary embodiment. The basket assembly 200 may include a main basket 202 and first and second supplemental baskets 204, 206 as discussed earlier. The basket assembly 200 may further include a third supplemental basket 260. The third supplemental basket 260 and/or the main basket 202 may include a coupling mechanism 262 that allows the third supplemental basket 260 to be selectively secured to the main basket 202. For example, third supplemental basket 260 may include one or more loops 262*a* that accept corresponding hooks 262*b* formed by the main basket 202. The third supplemental basket 260 may be formed of a relatively flexible and compliant material (e.g., a material measuring approximately 70-80 on a durometer). Such a material would be significantly more compliant than the relatively rigid polymeric material from which many standard dishwasher baskets are formed, and may provide a useful alternative for holding fragile items during a machine washing cycle. For example, when one or more of the loops 262*a* are removed from the corresponding hooks 262*b*, the third supplemental basket 260 takes the form of an open mouth pouch or bag secured to the main basket 202. The additional items are placed in the third supplemental basket 260 whereupon the loops 262*a* may or may not be placed back over the hooks 262*b*. In some embodiments, the hooks 262*b* may include lateral protrusions that make the total width of the hooks larger than the undeformed width of the loops 262*a*. In that way, the loops 262*a* may be stretched in order to be forced over the hooks 262*b*, thereby enhancing the securing of the supplemental basket 260 to the basket 202.

Figure 12:
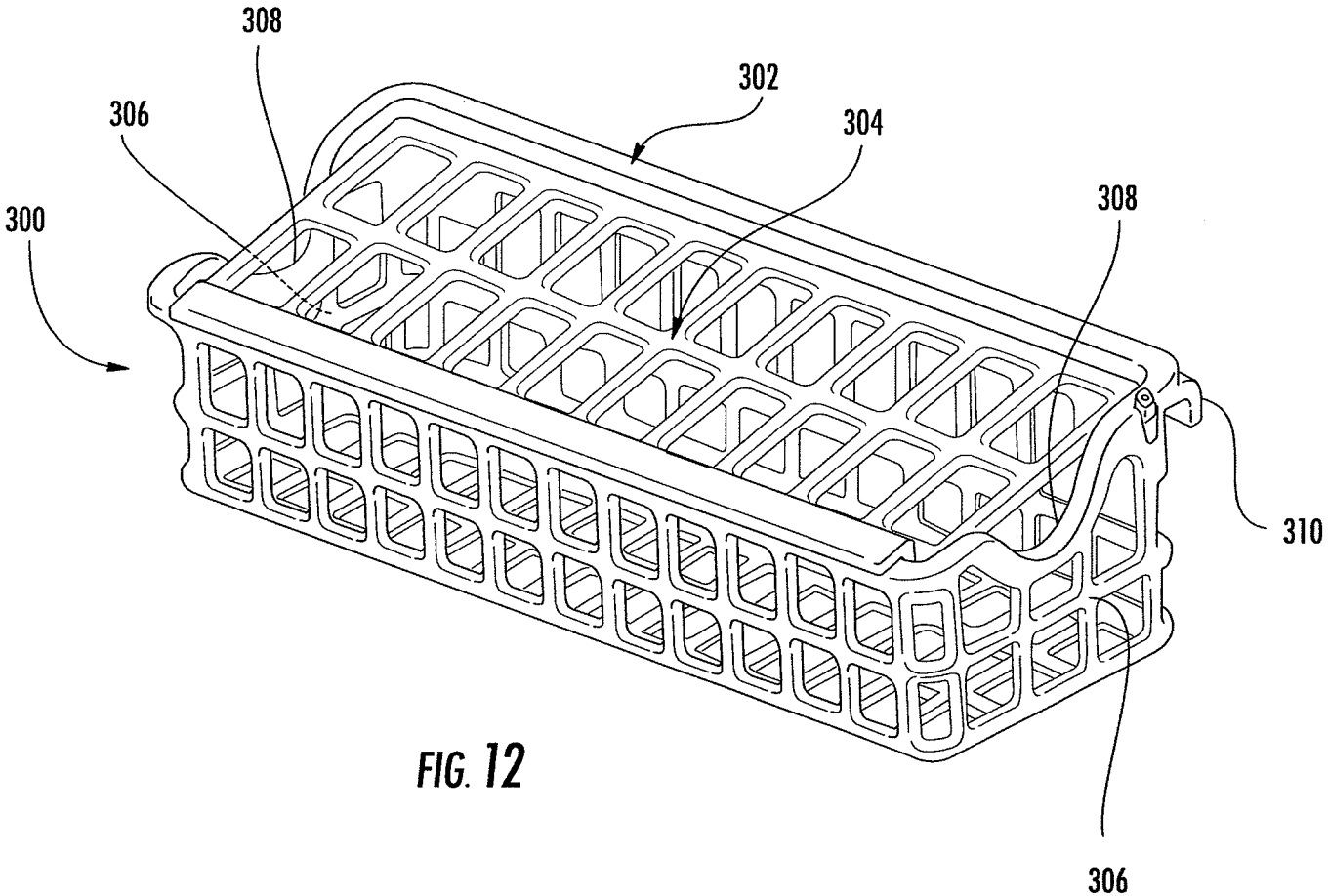
FIG. 12 is a perspective view of a basket configured in accordance with yet another exemplary embodiment.

Referring to FIG. 12, therein is shown a basket 300 configured in accordance with another exemplary embodiment. The basket 300 may include a container portion 302 and a lid portion 304. The lid portion 304 may be rotationally coupled to the container portion 302, thereby allowing the lid portion to be rotated relative to the container portion to expose an internal volume of the container portion. The container portion 302 includes opposing side surfaces 306. The side surfaces 306 define concavities 308 that may be used by the consumer to support long items extending through the basket 300. As such, when an elongate item is inserted into either or both of the concavities 308 and the lid portion 304 is in a closed position with respect to the concavities 308, as shown in FIG. 12, the basket 300 can contain an item having a length longer than that of the basket 300. The basket 300 may also include one or more hooks 310 for attaching the basket 300 to another structure, such as, for example, the top rail of a dishwasher rack.

Figure 13A:
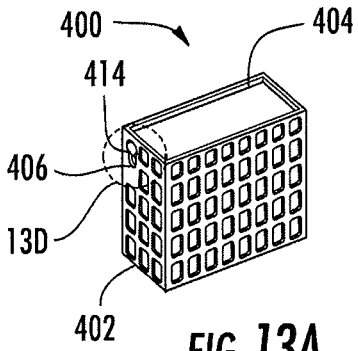
FIG. 13A is a perspective view of a basket assembly configured in accordance with yet another exemplary embodiment, the basket assembly defining a keyway for receiving a protrusion.
Figure 13B:
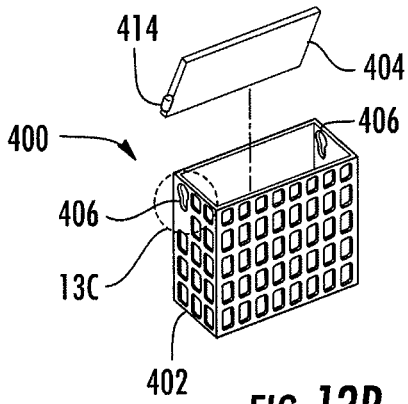
FIG. 13B is a perspective exploded view of the basket assembly of FIG. 13A.
Figure 13C:
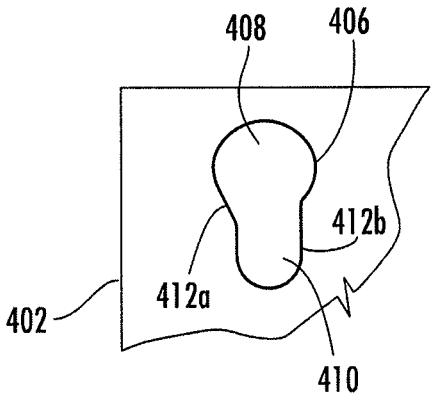
FIG. 13C is a magnified side view of the designated portion of the basket assembly of FIG. 13B.

Referring to FIGS. 13A and 13B, therein are shown perspective views of a basket assembly 400 configured in accordance with yet another exemplary embodiment, the basket assembly being in respective assembled and disassembled states. The basket assembly 400 may include a container portion 402 and a lid 404. The container portion 402 can define a keyway, or in some cases a pair of opposing keyways 406. Referring to FIG. 13C, each keyway 406 may have contiguous wider and narrower regions 408, 410, with the narrower region 410 being at least partially bounded by opposing oblique sides 412*a*, 412*b*. In one embodiment, one of the oblique sides 412*b* may be substantially aligned with a depth direction d of the container portion 402 while the other oblique side, side 412*a*, may be inclined with respect to the depth direction d. The wider region 408 may be substantially circular, and may be positioned adjacent to the narrower region 410 such that the wider and narrower regions are substantially aligned along the depth direction d.

Figure 13D:
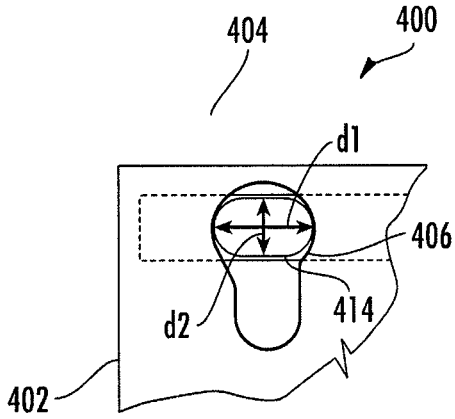
FIG. 13D is a magnified side view of the designated portion of the basket assembly of FIG. 13A.

Referring to FIGS. 13A and 13D, the lid 404 can include a protrusion 414 that extends from the lid in an extension direction e. The protrusion 414 may have a cross-section extending transversely to the extension direction e that has a longer dimension d1 and a shorter dimension d2. For example, the protrusion 414 may be a substantially elliptical projection extending from the lid in the extension direction e.

Figure 13E:
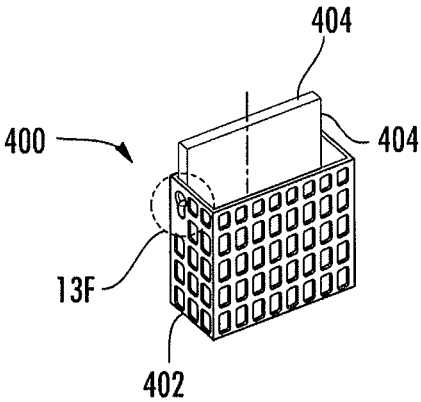
FIG. 13E is a perspective view of the basket assembly of FIG. 13A, the lid of the assembly being in an open position with respect to the container portion.
Figure 13F:
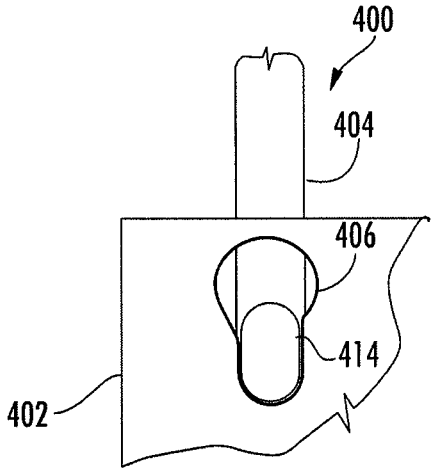
FIG. 13F is a magnified side view of the designated portion of the basket assembly of FIG. 13E.

Referring to FIGS. 13A and 13D-13F, when the lid 404 and container portion 402 are assembled together, the keyway 406 may receive the protrusion 414. The wider region 408 of the keyway 406 can be configured to accommodate the longer dimension d1 of the protrusion 414, while the narrower region 410 can be configured to accommodate the shorter dimension d2. The lid 404 may then rotate with respect to the container portion 402 between an open position (e.g., as shown in FIG. 13E) and a closed position (e.g., as shown in FIG. 13A). Because the protrusion 414 has a non-circular cross-section when viewed along the extension direction e, in some embodiments, the protrusion may rest stably in the narrower region 410 of the keyway 406 when the lid 404 is in the open position, thereby discouraging accidental closing of the lid. When the lid 404 is urged from an open position toward a closed position, the protrusion 414 can move into and be accommodated by the wider region 408. In some embodiments, the oblique sides 412*a*, 412*b* may facilitate the protrusion 414 sliding from the narrower region 410 to the wider region 408 as force is applied to a distal end 404*a* of the lid 404.

Many modifications and other embodiments of the inventions set forth herein will come to mind to one skilled in the art to which these inventions pertain having the benefit of the teachings presented in the foregoing descriptions and the associated drawings. For example, although some baskets and lids have been described as having specific hinge structures or lattice features, it should be understood that the various characteristics described above can generally be rearranged and reconfigured such that each basket and/or lid may possess any of the described features. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A basket assembly comprising:

a container portion comprising a bottom surface and a sidewall, the sidewall having an inner surface and an outer surface, the container portion further comprising an interference portion disposed on the inner surface of the sidewall within the container portion; and a lid rotationally coupled to said container portion and including an outer surface and an inner surface, the lid comprising a rib extending outwardly from the outer surface at a location proximal to an axis of rotation of said lid, said lid being configured to engage with the interference portion within said container portion as said lid is rotated between a closed position and an open position relative to said container portion, the interference between the rib and the interference portion being configured to maintain the lid in at least one of the open position and the closed position, wherein the interference portion defines a concavity configured to receive the rib subsequent to the lid being rotationally urged past the interference portion toward the open position such that the rib is disposed within the concavity when said lid is substantially in the open position.

2. A basket assembly according to claim 1, wherein said interference portion is configured to engage with said rib only when said lid is in an intermediate position between the closed position and the open position.

3. A basket assembly according to claim 2, wherein said interference portion is configured to engage with said rib so as to maintain said lid in substantially the open position subsequent to said lid being rotationally urged past the interference portion toward the open position.

4. A basket according to claim 1, wherein at least one of said interference portion and said rib is resiliently deformable so as to facilitate the lid being rotationally urged past the interference portion.

5. A basket assembly according to claim 4, wherein said interference portion is cantilevered with respect to the container portion.

6. A basket assembly comprising:

a container portion comprising a bottom surface and a sidewall, the sidewall defining an opening opposite the bottom surface extending within a first plane;

a handle including a grip portion disposed above the opening, said handle being coupled to said container portion such that said grip portion extends in a handle plane that is substantially perpendicular to the first plane;

a first lid rotationally coupled to said container portion adjacent to said grip portion and configured to at least partially cover the opening in a closed position, said first lid extending within a first lid plane substantially perpendicular to said handle plane of said grip portion in the closed position; and a second lid rotationally coupled to said container portion adjacent to said first lid and said grip portion, said second lid having a second lid plane substantially perpendicular to said handle plane of said grip portion in the closed position and being configured to rotate in a second rotational direction opposite to the first rotational direction.

7. A basket assembly according to claim 6, wherein said first lid is configured to be rotatable in a first rotational direction about a first axis of rotation to an open position allowing access to the grip portion.

8. A basket assembly according to claim 6, wherein said first and second axes of rotation are spaced apart a distance greater than a length of the grip portion.

9. A basket assembly according to claim 6, wherein said second lid is rotatable in the second rotational direction about a second axis of rotation to an open position allowing access to said grip portion.

10. A basket assembly according to claim 9, wherein said first and second lids include respective distal ends opposing the corresponding one of the first and second axes of rotation, and are rotatable about the respective first and second axes of rotation to respective substantially closed positions, whereby the distal ends of said first and second lids are adjacently disposed and said first and second lids cooperate to cover the opening of said container portion.

11. A basket assembly according to claim 10, wherein when said first and second lids are disposed in the respective open positions, the respective distal ends are spaced apart so as to allow access to said grip portion.

12. A basket assembly comprising:

a container portion comprising a bottom surface and a sidewall, the sidewall defining an opening opposite the bottom surface extending within a first plane;

a lid operably engaged with the container portion and extending along a lid plane across an opening defined by the container portion when said lid is in a closed position, said lid being rotationally coupled with said container portion so as to be rotatable about an axis of rotation between the closed position and an open position, said lid comprising a distal end opposite the axis of rotation and opposing sides extending between the distal end and the axis of rotation; and a fin defined by the lid and extending from one of the sides of said lid in a direction substantially perpendicular to the lid plane, wherein the fin is configured to rotate with the lid about the axis of rotation, said fin generally defining a fin plane extending perpendicularly to the axis of rotation, said fin spaced from the axis of rotation and the distal end such that the fin is defined partially between the distal end and the axis of rotation, the axis of rotation defined below the first plane such that said fin is spaced above the first plane when said lid is in the open position.

13. A basket assembly according to claim 12, wherein said fin is substantially planar.

14. A basket assembly according to claim 12, wherein said fin is disposed partially about a perimeter of said lid along one of the sides.

15. A basket assembly according to claim 12, wherein said lid is rotationally coupled to the container portion via a coupling structure including protrusions extending from opposite sides of said lid, the protrusions being configured to be received by corresponding mating structures defined by said container portion, the mating structures being disposed along the axis of rotation.

16. A basket assembly according to claim 15, wherein said coupling structure is configured to maintain said lid in an open position relative to said container portion.

17. A lid for a basket, the basket comprising a bottom surface and a sidewall, the sidewall defining an opening opposite the bottom surface extending within a first plane, said lid comprising:

a lid body;

a coupling structure associated with said lid body and configured to rotationally couple said lid body to the basket, said coupling structure defining an axis of rotation about which said lid body rotates between a closed position and an open position when coupled to the basket, said lid body comprising a distal end opposite the axis of rotation and opposing sides extending between the distal end and the axis of rotation; and a fin defined by the lid body and extending from said lid body in a direction substantially perpendicular to a plane generally defined by said lid body, wherein the fin is configured to rotate with the lid body about the axis of rotation, said fin generally defining a fin plane extending perpendicularly to the axis of rotation, said fin spaced from the axis of rotation and the distal end such that said fin is defined partially between the distal end and the axis of rotation, the axis of rotation defined below the first plane such that said fin is spaced above the first plane when said lid body is in the open position.

18. A lid according to claim 17, wherein said fin is substantially planar.

19. A lid according to claim 17, wherein said fin is disposed partially about a perimeter of said lid body along one of the sides.

20. A lid according to claim 17, wherein said coupling structure includes one of a pair of opposing protrusions configured to be received by mating structures defined by said basket or a pair of opposing cavities configured to receive mating structures defined by said basket.

21. A basket assembly comprising:

a container portion comprising a bottom surface and a sidewall, the sidewall defining an opening opposite the bottom surface and having an inner surface and an outer surface; and a lid rotationally coupled to said container portion and adapted to receive an elongated item therethrough into the container portion when said lid is disposed in each of a first rotational position and a second rotational position, said lid being rotatable about an axis of rotation between an open position and a closed position, said lid configured to extend partially within the opening to engage the inner surface of the sidewall in the open position, wherein said lid defines a lid plane and further includes spaced apart first and second lid members defining respective first and second planes, the first and second planes disposed parallel to the lid plane, said lid further comprising a third lid member defining a third plane disposed perpendicular to the lid plane, the third lid member being operably engaged between the first and second lid members.

22. A basket assembly according to claim 21, wherein each of said first, second, and third lid members cooperate to define a three-dimensional lattice, wherein each of said first, second, and third lid members defines an aperture adapted to receive the elongated item therethrough.

23. A basket assembly according to claim 21, wherein the first rotational position is the open position and the second rotational position is the closed position, the first and second rotational positions being substantially perpendicular to one another.

* * * * *